US008920141B2

(12) United States Patent
Durand et al.

(10) Patent No.: US 8,920,141 B2
(45) Date of Patent: Dec. 30, 2014

(54) MECHANICAL COMBUSTION ENGINE COOLANT PUMP

(75) Inventors: Jean-Michel Durand, Metz (FR); Pierre Reininger, Basse-Ham (FR); Laurent Finidori, Bertrange (FR)

(73) Assignee: Pierburg Pump Technology GmbH, Neuss (DE)

( * ) Notice: Subject to any disclaimer, the term of this patent is extended or adjusted under 35 U.S.C. 154(b) by 309 days.

(21) Appl. No.: 13/521,056

(22) PCT Filed: Aug. 24, 2010

(86) PCT No.: PCT/EP2010/062331

§ 371 (c)(1),
(2), (4) Date: Sep. 3, 2012

(87) PCT Pub. No.: WO2011/082841

PCT Pub. Date: Jul. 14, 2011

(65) Prior Publication Data

US 2012/0321487 A1 Dec. 20, 2012

(30) Foreign Application Priority Data

Jan. 11, 2010 (EP) ..... 10150437

(51) Int. Cl.

| | |
|---|---|
| ***F04D 29/049*** | (2006.01) |
| ***F01P 5/12*** | (2006.01) |
| ***F04D 13/02*** | (2006.01) |
| ***F04D 29/62*** | (2006.01) |

(52) U.S. Cl.

CPC . *F01P 5/12* (2013.01); *F04D 13/02* (2013.01); *F04D 29/049* (2013.01); *F04D 29/628* (2013.01)

USPC ..... 417/423.12

(58) Field of Classification Search

CPC ..... F04D 29/049

USPC ..... 417/423.6, 223, 319, 364, 423.12

See application file for complete search history.

(56) References Cited

U.S. PATENT DOCUMENTS

| | | | | |
|---|---|---|---|---|
| 3,838,899 | A | 10/1974 | Sampatacos | |
| 4,911,610 | A | 3/1990 | Olschewski et al. | |
| 7,144,225 | B2 * | 12/2006 | Boffelli et al. | 417/223 |
| 2002/0034438 | A1 * | 3/2002 | Ozawa et al. | 415/111 |

(Continued)

FOREIGN PATENT DOCUMENTS

| | | | |
|---|---|---|---|
| CN | 1702331 | A | 11/2005 |
| CN | 101082372 | A | 12/2007 |

(Continued)

*Primary Examiner* — Bryan Lettman

(74) *Attorney, Agent, or Firm* — Norman B. Thot

(57) ABSTRACT

A mechanical combustion engine coolant pump for pumping a coolant for an internal combustion engine includes a pump wheel. A rotor shaft is arranged at the pump wheel. The rotor shaft is rotatable and radially supported. A driving wheel is rotatable, radially supported is driven by the internal combustion engine. A connecting device is connects the rotor shaft with the driving wheel so as to be rotatably fixed. A first roller bearing comprises a separate outer bearing ring. The separate outer bearing is directly fixed to a pump frame body. The first roller bearing directly radially supports the rotor shaft or the driving wheel. A separate bearing fixation structure axially pushes the separate outer bearing ring of the first roller bearing so as to be clearance-free against the pump frame body so that the separate bearing fixation structure is directly fixed to the pump frame body.

9 Claims, 2 Drawing Sheets

(56) References Cited

U.S. PATENT DOCUMENTS

| | | | | |
|---|---|---|---|---|
| 2006/0165539 | A1 | 7/2006 | Boffelli et al. | |
| 2007/0243085 | A1 * | 10/2007 | Adachi et al. | 417/420 |
| 2008/0167149 | A1 | 7/2008 | Beauprez et al. | |

FOREIGN PATENT DOCUMENTS

| | | | |
|---|---|---|---|
| DE | 37 16 098 | A1 | 11/1988 |
| EP | 1 188 931 | A2 | 3/2002 |
| EP | 1 696 111 | A2 | 8/2006 |
| JP | 62-108595 | U | 7/1987 |
| JP | 2-34792 | U | 3/1990 |
| JP | 2002-155893 | A | 5/2002 |
| JP | 2004-52669 | A | 2/2004 |
| JP | 2004-150300 | A | 5/2004 |

* cited by examiner

MECHANICAL COMBUSTION ENGINE COOLANT PUMP

CROSS REFERENCE TO PRIOR APPLICATIONS

This application is a U.S. National Phase application under 35 U.S.C. §371 of International Application No. PCT/EP2010/062331, filed on Aug. 24, 2010 and which claims benefit to European Patent Application No. 10150437.1, filed on Jan. 11, 2010. The International Application was published in English on Jul. 14, 2011 as WO 2011/082841 A1 under PCT Article 21(2).

FIELD

The present invention relates to a mechanical combustion engine coolant pump for pumping a coolant for an internal combustion engine.

BACKGROUND

A mechanical coolant pump is provided with a pump wheel and a rotatable rotor shaft being radially and axially supported by a roller bearing. The outer bearing ring of the roller bearing is normally press-fit into a cylindrical part of the stationary pump frame body. If the mechanical coolant pump is switchable with a friction clutch, another roller bearing is provided to support the rotatable driving wheel. If the driving wheel is directly supported by the stationary pump frame body, the outer ring of the roller bearing is press-fit into a cylindrical part of the pump frame body.

The press-fitting of the outer bearing ring of the roller bearing into a cylindrical part of the pump frame body requires very precisely manufactured cylindrical press-fit surfaces of the corresponding parts. Additionally, the fixing procedure is complicated as well.

SUMMARY

An aspect of the present invention is to provide a mechanical combustion engine coolant pump which can be manufactured and assembled easily and cost and effectively.

In an embodiment, the present invention provides a mechanical combustion engine coolant pump configured to pump a coolant for an internal combustion engine which includes a pump wheel. A rotor shaft is arranged at the pump wheel. The rotor shaft is configured to be rotatable and to be radially supported. A driving wheel is configured to be rotatable, to be radially supported and to be driven by the internal combustion engine. A connecting device is configured to connect the rotor shaft with the driving wheel so as to be rotatably fixed. A first roller bearing comprises a separate outer bearing ring. The separate outer bearing is directly fixed to a pump frame body. The first roller bearing is configured to directly radially support the rotor shaft or the driving wheel. A separate bearing fixation structure is configured to axially push the separate outer bearing ring of the first roller bearing so as to be clearance-free against the pump frame body so that the separate bearing fixation structure is directly fixed to the pump frame body.

BRIEF DESCRIPTION OF THE DRAWINGS

The present invention is described in greater detail below on the basis of embodiments and of the drawings in which.

DETAILED DESCRIPTION

Figure 1:
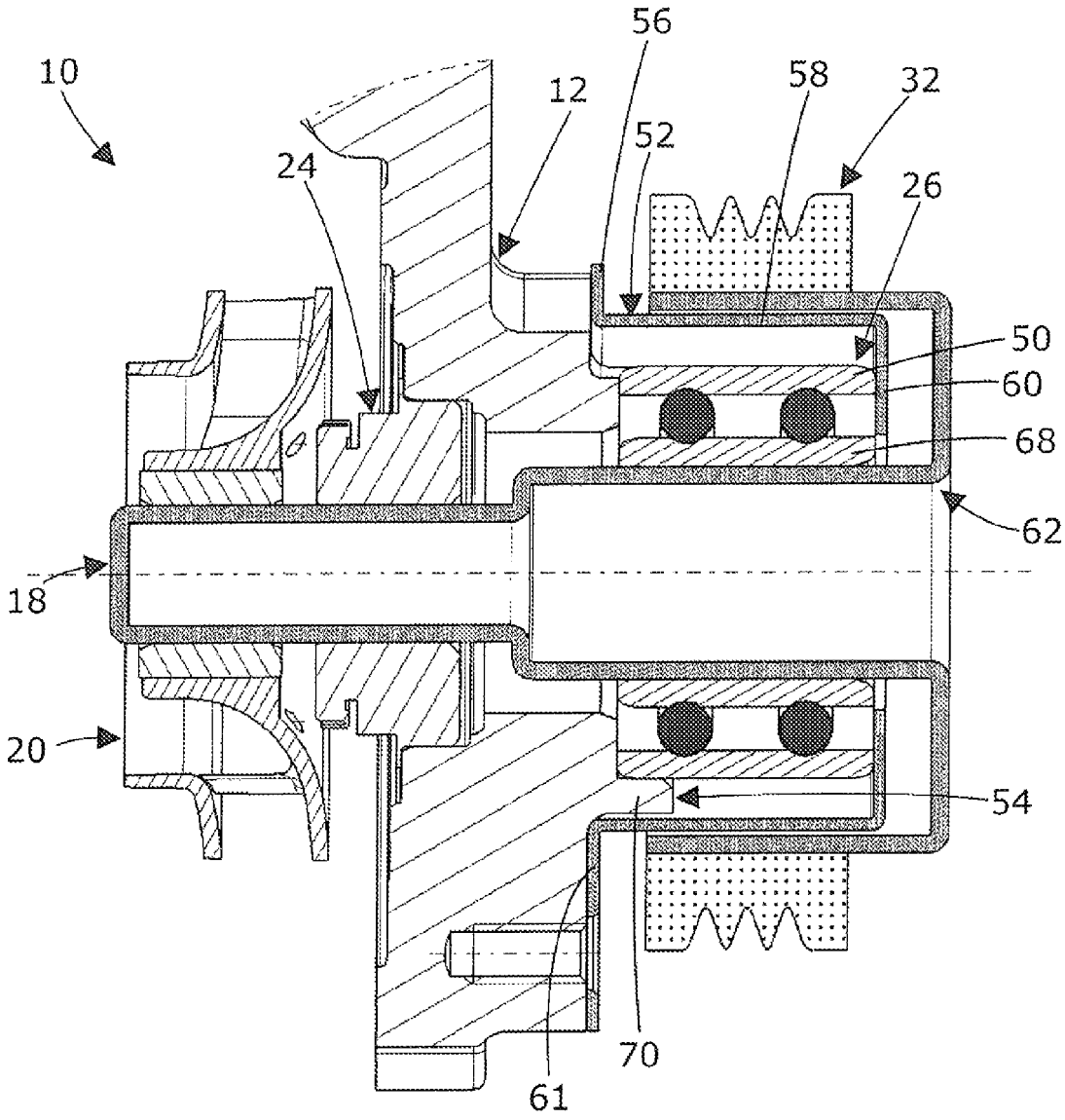
FIG. 1 shows a longitudinal cross-section of a non-switchable combustion engine coolant pump.

In an embodiment, the present invention provides a switchable and a non-switchable mechanical coolant pump. The pump wheel is provided at a rotatable rotor shaft which is radially and axially supported. The rotatable driving wheel is driven by the combustion engine and is radially and axially supported as well. If the coolant pump is non-switchable, the pump wheel and the driving wheel both are directly supported by a first roller bearing. If the coolant pump is switchable by a friction clutch, the driving wheel can be directly supported by the first roller bearing at the pump frame body and the pump wheel rotor shaft can be directly supported by a second roller bearing at the driving wheel. In this case, the pump wheel is only indirectly supported by the first roller bearing at the pump frame body.

In other words, the first roller bearing is always supporting a rotatable part of the pump directly at the pump frame body. The rotatable part can be the rotor shaft or can be the driving wheel.

The rotor shaft can permanently or non-permanently be connected with the driving wheel in a rotatably fixed manner by connecting means. The connecting means can be a stiff structure or it can be a clutch, for example, a friction clutch.

The first roller bearing is provided with a separate outer ring which is directly fixed to the pump frame body. A separate bearing fixation structure is provided which is axially pushing the outer ring clearance-free against the pump frame body. The bearing fixation structure itself is directly fixed to the pump frame body by fixation means. The outer ring of the first roller bearing is not press-fit to the pump frame body but is axially pushed with a high pushing force against a suitable transversal surface of the pump frame body. As a consequence, the bearing fixation structure has to be at least minimally elastic.

Since no precise press-fittable parts are needed anymore, the production of the respective parts is less cost-intensive. At least one press-fit process can be avoided, so that the assembling is significantly simplified. In contrast to a press-fit connection, the fixation of the fixation structure at the pump frame body can be detachable. A pre-fabricated standard roller bearing can be used for the first roller bearing, which is less expensive.

The bearing fixation structure can generally be provided with centering means for precisely centering of the first roller bearing at the pump frame body. The pump frame body can, for example, be provided with a bearing centering structure for radially centering the outer ring of the first roller bearing at the pump frame body. The centering structure can be realized by three or more centering noses, by a centering ring, by a centering notch etc.

In an embodiment of the present invention, the bearing fixation structure can, for example, be a single sheet metal body with a cylinder part housing the first rollor bearing, with a bearing fixation ring projecting radially inwardly from the distal axial end of the cylinder part, and with a mounting flange projecting radially outwardly from the proximal end of the cylinder part. The sheet metal body can be produced very cost-effectively and is provided with the needed elastic properties. The form of the bearing fixation structure is similar to a pot with a central opening in the base and with an outward flange ring which is mounted to the pump frame body.

In an embodiment of the present invention, the connecting means connecting the rotor shaft and the driving wheel can, for example, be a permanent connection so that the first roller bearing is directly engaged at the rotor shaft. The coolant pump is non-switchable. In an embodiment of the present invention, one single rotor body can, for example, be provided forming the rotor shaft and being directly engaged with the driving wheel. The rotor body can be a sheet metal body or can be manufactured out of solid material.

In an embodiment of the present invention, the connecting means connecting the rotor shaft with the driving wheel can, for example, be a friction clutch actuated by an electromagnet. In this constitution, the first roller bearing is directly engaged with and is directly supporting the driving wheel. The rotor shaft is directly supported by a second roller bearing at a cylindrical rotor part of the driving wheel. The coolant pump is switchable. The friction clutch can be arranged at the distal end of the coolant pump, whereas the pump wheel is arranged at the other distal end of the coolant pump.

In an embodiment of the present invention, the electromagnet can, for example, be a stationary circular ring coil arranged axially distal of the first roller bearing. This is a very compact arrangement which allows the arrangement of a ring coil with a relatively high radial extension as close as possible to the clutch mechanism.

In an embodiment of the present invention, the electromagnet ring coil can, for example, be directly fixed to the bearing fixation structure so that the bearing fixation structure has a second relevant function.

Figure 2:
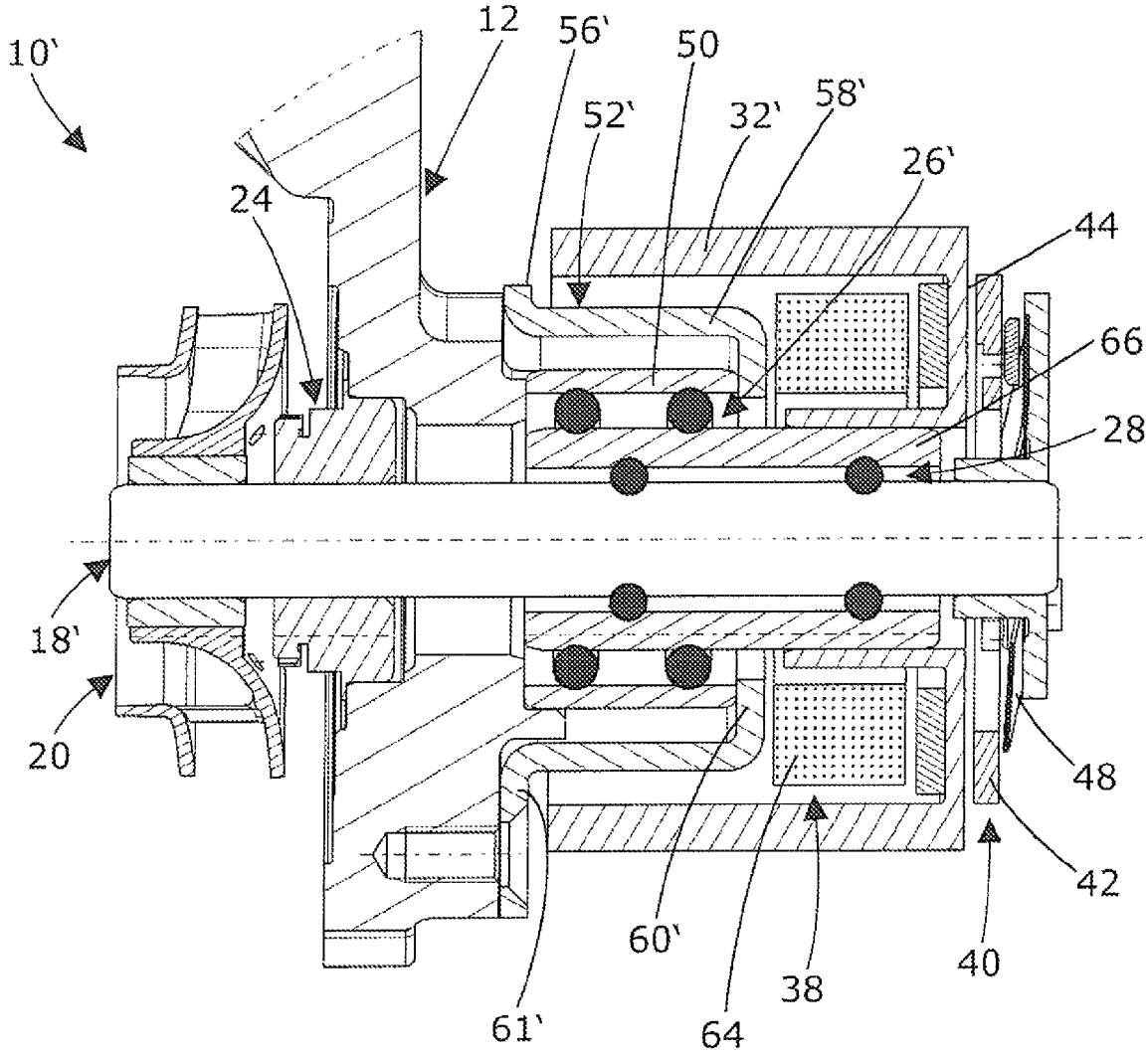
FIG. 2 shows a longitudinal cross-section of a switchable combustion engine coolant pump.

Both FIGS. 1 and 2 show a mechanical combustion engine coolant pump 10, 10' for pumping a coolant, for example water, for and to an internal combustion engine. FIG. 2 shows a switchable coolant pump 10' comprising a clutch 40 connecting two independently rotatable rotors. FIG. 1 shows a non-switchable coolant pump 10 with one single rotor.

Both pump embodiments shown in FIGS. 1 and 2 are provided with a first roller bearing 26; 26' comprising a separate outer ring 50 which is directly fixed to a pump frame body 12. The outer ring 50 of the respective first roller bearing 26; 26' is respectively fixed to the pump frame body 12 by a separate bearing fixation structure 52; 52'. The bearing fixation structure 52; 52' axially pushes the outer ring 50 of the first roller bearing 26; 26' clearance-free against the pump frame body 12. The bearing fixation structure 52; 52' is directly fixed to a transversal ring plane of the pump frame body 12.

The bearing fixation structure 52; 52' of both embodiments is made out of a single sheet metal body 56; 56' and is provided with a cylinder part 58; 58' housing the first roller bearing 26; 26', with a bearing fixation ring 60; 60' projecting radially inwardly from the distal axial end of the cylinder part 58; 58' and with a mounting flange 61; 61' projecting radially outwardly from the proximal end of the cylinder part 58. The fixation structure sheet-metal body 56 is in axial direction minimally resilient so that the fixation of the outer ring 50 is tolerant with respect to mechanical inaccuracies.

The pump frame body 12 is provided with a bearing centering structure 54 which radially centers the outer ring 50 of the first roller bearing 26; 26'. The bearing centering structure 54 is realized by four centering noses 70 which force the outer ring 50 of the first roller bearing 26; 26' into the center position without exerting relevant radial clamping forces. The axial length of the centering noses 70 is less than one fourth of the axial length of the outer bearing ring 50.

The coolant pump 10 of FIG. 1 is provided with a pump wheel 20 which is fixed to a rotor shaft 18. The rotor shaft 18 is formed by one single rotor body 62 out of sheet metal. The rotor body 62 directly connects the pump wheel 20 with the separate driving wheel 32 and forms a connection means. The driving wheel 32 is driven by a driving belt which is driven by the internal combustion engine.

The first roller bearing 26 comprises the outer bearing ring 50, a separate inner bearing ring 68 and rolling elements therebetween. The inner bearing ring 68 is press-fit onto the outer cylindrical surface of the rotor shaft 18. The ring-like clearance between the rotor shaft 18 and the housing 12 is sealed by a shaft sealing 24.

In contrast to the coolant pump 10 of FIG. 1, the switchable coolant pump 10' of FIG. 2 is provided with a friction clutch 40 as a connecting means for connecting the pump wheel 20 with the driving wheel 32'. The coolant pump 10' is therefore provided with two independently rotating structures and with a second roller bearing 28.

The first roller bearing 26 supports a cylindrical rotor 66 of the driving wheel 32'. The second roller bearing 28 supports the rotor shaft 18 at the cylindrical rotor 66 of the driving wheel 32'. The inner bearing ring of the first roller bearing 26' is an integral part of the cylindrical rotor part 66 of the driving wheel 32'.

The outer bearing ring of the second roller bearing 28 is integrally defined by the surface of the cylindrical rotor part 66 of the driving wheel 32'. The inner bearing ring of the second roller bearing 28 is integrally defined by the rotor shaft 18. The axial length of the first roller bearing 26' is less than the axial length of the second roller bearing 28.

The mechanical friction clutch 40 is provided with an axially shiftable friction ring 42 supported by the rotor shaft 18 and with an opposite friction ring 44 formed by a transversal ring-like surface of the driving wheel 32'. Inside the ring-like cavity, which is enclosed by the U-shaped driving wheel 32', a stationary electromagnet 38 is arranged which is axially mounted to the bearing fixation structure 52'.

The electromagnet 38 consists of a ring-like exciting coil 64 which generates a toroidal electromagnetic field when the electromagnet 38 is energized with DC. When the electromagnet 38 is energized, the clutch 40 is engaged.

The present invention is not limited to embodiments described herein; reference should be had to the appended claims.

What is claimed is:

1. A mechanical combustion engine coolant pump configured to pump a coolant for an internal combustion engine, the mechanical combustion engine coolant pump comprising:

a pump wheel;

a rotor shaft arranged at the pump wheel, the rotor shaft being configured so as to be rotatable and to be radially supported;

a driving wheel configured to be rotatable, to be radially supported and to be driven by the internal combustion engine;

a connecting device configured to connect the rotor shaft with the driving wheel so as to be rotatably fixed;

a first roller bearing comprising a separate outer bearing ring, the separate outer bearing ring being directly fixed to a pump frame body, the first roller bearing being configured to directly radially support the rotor shaft or the driving wheel; and a separate bearing fixation structure configured to axially push the separate outer bearing ring of the first roller bearing so as to be clearance-free against the pump frame body so that the separate bearing fixation structure is directly fixed to the pump frame body, the separate bearing fixation structure being provided as a single sheet metal body comprising a cylinder part configured to house the first roller bearing, a bearing fixation ring configured to project radially inwardly from a distal axial end of the cylinder part, and a mounting flange configured to project radially outwardly from a proximal end of the cylinder part.

2. The mechanical combustion engine coolant pump as recited in claim 1, wherein the pump frame body includes a bearing centering structure configured to radially center the separate outer bearing ring of the first roller bearing at the pump frame body.

3. The mechanical combustion engine coolant pump as recited in claim 1, wherein the connecting device is a permanent connection of the rotor shaft with the driving wheel, and wherein the first roller bearing is configured to be directly engaged with the rotor shaft.

4. The mechanical combustion engine coolant pump as recited in claim 3, further comprising one single rotor body, the one single rotor body being configured to form the rotor shaft and to be directly engaged with the driving wheel.

5. The mechanical combustion engine coolant pump as recited in claim 4, wherein the one single rotor body is made of a single sheet metal piece, and wherein the driving wheel is a separate part fixed to the rotor body.

6. The mechanical combustion engine coolant pump as recited in claim 1, further comprising an electromagnet, a second roller bearing, and a cylindrical rotor part of the driving wheel, wherein the connecting device is a friction clutch configured to be actuated by the electromagnet, wherein the first roller bearing is configured to be directly engaged with the driving wheel, and wherein the rotor shaft is configured to be directly supported by the second roller bearing at the cylindrical rotor part of the driving wheel.

7. The mechanical combustion engine coolant pump as recited in claim 6, wherein the electromagnet is a ring coil which is arranged so as to be axially distal of the first roller bearing.

8. The mechanic combustion engine coolant pump as recited in claim 6, wherein the second roller bearing is arranged so as to be radially inward of the first roller bearing.

9. The mechanical combustion engine coolant pump as recited in claim 6, wherein the electromagnet is fixed to the separate bearing fixation structure.

* * * * *